United States Patent [19]

Bennett

[11] Patent Number: 4,892,234

[45] Date of Patent: Jan. 9, 1990

[54] COMBINED CLOSURE AND POURING SPOUT

[75] Inventor: Mark H. Bennett, Winfield, Kans.

[73] Assignee: Gott Corporation, Winfield, Tex.

[21] Appl. No.: 222,621

[22] Filed: Jul. 21, 1988

[51] Int. Cl.[4] ..... B67D 3/00

[52] U.S. Cl. ..... 222/484; 222/534

[58] Field of Search ..... 222/484, 526, 531–534, 222/536, 538, 478, 479; 215/13.1

[56] References Cited

U.S. PATENT DOCUMENTS

| | | | |
|---|---|---|---|
| 507,055 | 10/1893 | Wilson | 222/534 |
| 1,889,937 | 12/1932 | Spence | 222/531 X |
| 2,040,800 | 5/1936 | Bennett | 22/1 |
| 3,094,255 | 6/1963 | Hunter | 222/507 |
| 3,358,890 | 12/1967 | Dalfo | 222/507 |
| 3,490,659 | 1/1970 | LaVange et al. | 222/534 |
| 3,782,610 | 1/1974 | Gilbert | 222/484 |
| 4,013,200 | 3/1977 | Tripp | 222/534 |
| 4,282,992 | 8/1981 | Chessler | 222/538 |
| 4,320,859 | 3/1982 | Shy | 222/401 |
| 4,597,508 | 7/1986 | MacLarty | 222/83 |

FOREIGN PATENT DOCUMENTS

| | | | |
|---|---|---|---|
| 8143 | 3/1897 | United Kingdom | 222/533 |
| 445603 | 4/1936 | United Kingdom | 222/533 |

OTHER PUBLICATIONS

Advertising Sell Sheet, "The lil' sipper", Bee Plastics Corp., Leominster, MA 01453.

*Primary Examiner*—Michael S. Huppert

*Attorney, Agent, or Firm*—Renner, Kenner, Grieve, Bobak, Taylor & Weber

[57] ABSTRACT

A dispenser closure (10) for a container having a normally vertical axis and an off-center recess (14) in the top thereof wholly containing a laterally rotatable spout member (20) in its closed position. The spout member is adapted for rotation to an upwardly inclined open position projecting outwardly beyond the peripheral flange (11) of the closure.

6 Claims, 3 Drawing Sheets

COMBINED CLOSURE AND POURING SPOUT

TECHNICAL FIELD

In general, this invention relates to a capping and dispensing device providing improved dispensing of liquid material through the device. In particular, this invention relates to a novel vented pour spout of a simple construction which provides efficiency and convenience to users.

BACKGROUND ART

Dispensing closures, pour spouts and other dispensing devices are known in the art, but the designs heretofore known have failed to provide the beneficial attributes of the present dispensing device as will be readily apparent from the disclosure set forth herein.

An early dispensing device was that of the spigot, typically utilized in conjunction with kegs or other suitable containers, as is exemplified by the spigot disclosed in U.S. Pat. No. 1,889,937. This device, however, is extremely complex, consists of numerous parts, is difficult to manufacture, and is not dripless.

Dispensing closures having movable spouts, generally rotatable between an open and closed position, are also known. For example, U.S. Pat. No. 3,490,659 discloses a three-piece dispensing closure having a cap, lid and spout. The lid is located over the cap so as to hold the spout in sealed engagement with a hole in the cap. The spout is movable about the longitudinal axis of the container upon which the device is affixed, from a closed horizontal position to an open vertical position. Dispensing liquid through the lid is inconvenient due to the spout position, and further drip or sloppage from the spout is likely.

U.S. Pat. No. 4,013,200 also discloses a dispensing device having a movable spout. The bottle screw cap disclosed therein includes a spout member which is rotatable in a horizontal plane about the vertical axis of the cap from an open position where the spout is in communication with the hollow body of the cap to a closed position. The cap, however, is configured so as to dispense in a generally horizontal direction which inhibits easy pouring when the container is tipped.

Other retractable, or pivotal dispensing closures are also known such as those disclosed in U.S. Pat. Nos. 4,320,859 and 3,358,890. However, neither of these devices offer the beneficial advantages of the pour spout of the present invention.

DISCLOSURE OF THE INVENTION

It is a primary object to the present invention to provide an improved dispensing closure for containers.

It is another object of the present invention to provide an improved dispensing closure, as above, which can be simply and efficiently manufactured and which is made up of a small number of component parts.

It is yet another object of the present invention to provide an improved dispensing closure, as above, which includes a rotatable vented pour spout suitably configured so as to efficiently dispense liquid therethrough.

It is a further object of the present invention to provide an improved dispensing closure, as above, wherein the spout is rotatable from open to closed positions and is completely received within the top of the dispenser closure so as to prohibit accidental opening of the spout or damage thereto.

It is a further object of the present invention to provide an improved dispensing closure, as above, wherein the spout is rotatable to an open position in which it is upwardly angularly disposed with respect to the central vertical axis of the dispenser.

It is yet another object of the present invention to provide an improved dispensing closure, as above, wherein the spout is essentially drip proof.

It is yet another object of the present invention to provide an improved dispensing closure, as above, which is conveniently used with a variety of containers and a variety of viscous materials.

A further object of the present invention is to provide an improved dispensing closure, as above, in which the spout is provided with a vent which automatically closes when the spout is swung to closed position and opens when the spout is swung to open position.

These and other objects of the present invention which will become apparent from the description to follow, are accomplished by the improvements hereinafter disclosed and claimed. Various modifications and changes in constructions are comprehended within the scope of the appended claims.

In general, the improved dispensing closure of the present invention includes an upper wall with a downturned peripheral flange for fitting over the top of a container, the upper wall having a recess in which a spout is swiveled for rotating to an open position in which the spout is upwardly and outwardly inclined.

PREFERRED EMBODIMENT FOR CARRYING OUT THE INVENTION

Figure 4:
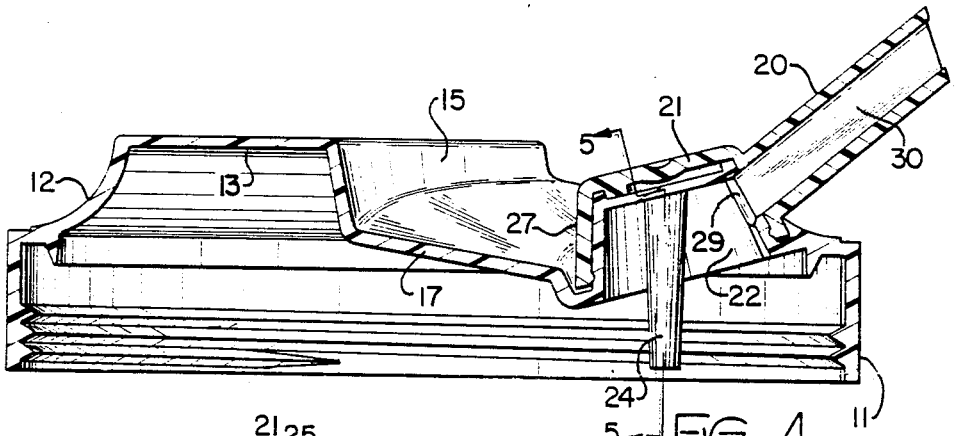
FIG. 4 is a vertical sectional view of the improved dispensing closure of the present invention taken substantially along line 4—4 of FIG. 2.

The improved dispenser container closure is indicated generally by the numeral 10 in the drawings and may include a downturned peripheral flange 11 for fitting over the top of a container. The flange 11 may be cylindrical, as shown, or be of different shape to fit a similarly shaped container. An upwardly curved arcuate wall 12 connects the top of flange 11 to a preferably flat normally horizontal crescent-shaped top wall 13.

The top wall 13 has an off-center recess formed therein, indicated generally at 14, which extends radially outward from the medial portion of the closure and intersects the curved wall 12. The recess 14 is formed by downwardly inclined curved walls 15 and 16 merging substantially at the medial portion of the closure and forming the inner periphery of the crescent-shaped top wall 13. The walls 15 and 16 intersect the bottom wall 17 of the recess which extends substantially radially outward and inclines upward to its intersection with the upwardly curved arcuate wall portion 12. The wall 16 has a substantially vertical shoulder portion 18 at its juncture with the bottom wall 17 of the recess.

As shown in FIGS. 2 to 5, a tubular spout member 20 can be provided with a hollow cup-shaped preferably frustoconical mounting portion 21 on one end which is adapted to telescopically snap over and rotatably interfit a hollow frusto-conical base 22 molded in the bottom wall 17 of recess 14. The base 22 is located adjacent to the intersection of wall 16 with arcuate wall 12 and adjacent to the outer periphery of the recess, which allows the spout to swing into the recess and abut the shoulder portion 18 in the closed position shown in FIG. 1.

Figure 5:
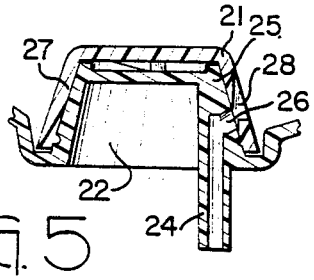
FIG. 5 is a sectional view of the improved dispensing closure of the present invention taken substantially along line 5—5 of FIG. 4.
Figure 2:
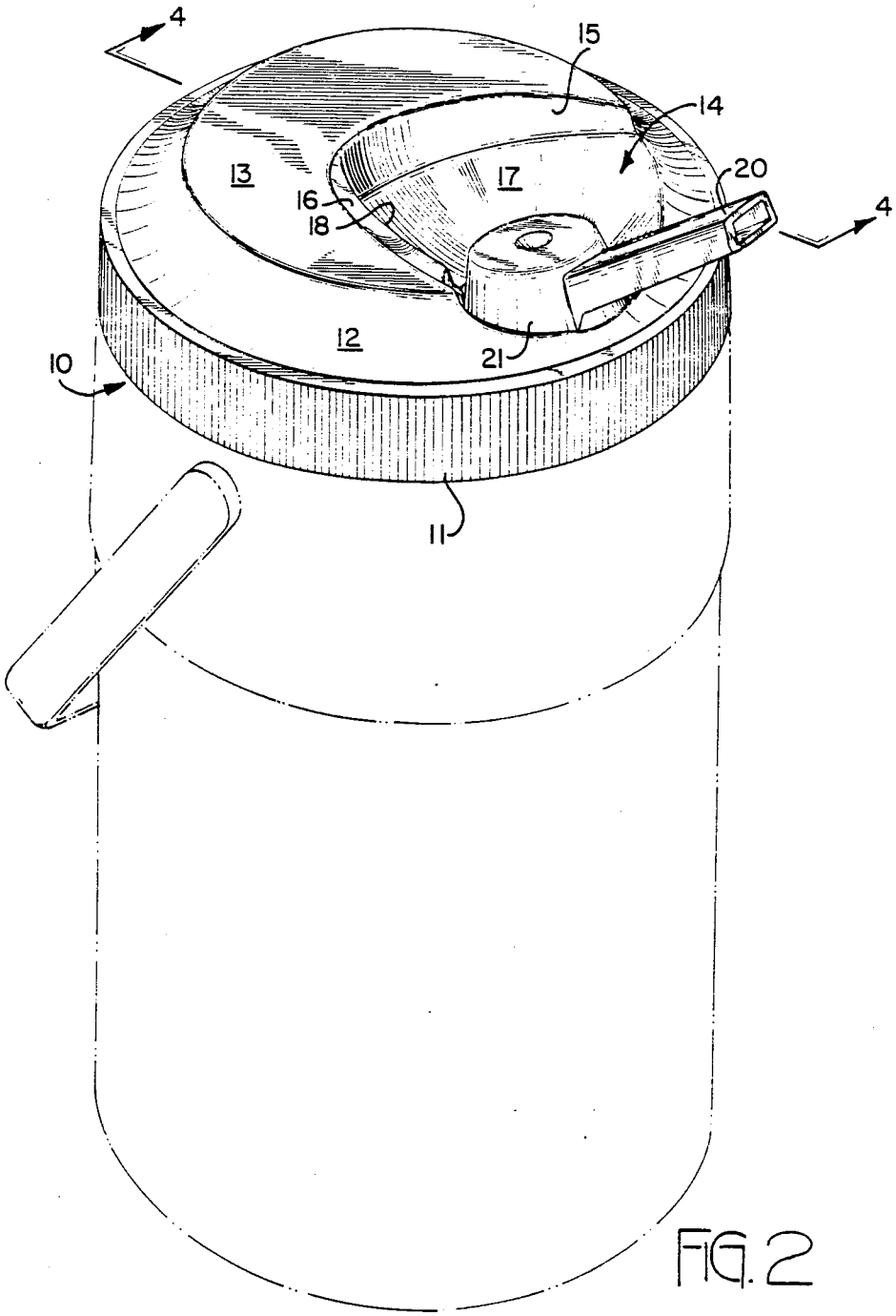
FIG. 2 is a perspective view of the improved dispensing closure of the present invention wherein the spout member is in the open position.

The axis of the base 22 is tilted inwardly from the vertical toward the normally vertical axis of the closure 10, so that when the spout is rotated laterally to the open position of FIGS. 2 and 5 the spout 20 is inclined outwardly upward at an angle and projects laterally outward beyond the closure, facilitating pouring the liquid content of a container attached to the dispenser closure 10. As indicated, the inclination of the bottom wall 17 of the recess is such as to permit lateral rotation of the spout 20 about 180° between open and closed positions.

As shown in FIGS. 4 and 5, an internal vent tube 24 depends from the sidewall 25 of the base and its upper end opens out through wall 25 at 26. The opening 26 is closed by the sidewall 27 of the mounting portion 21 when the spout 20 is in the closed position of FIG. 1, and is open to the atmosphere through an aperture 28 in sidewall 27 when the spout is in open position. The sidewall 27 also has an opening 29 therein which registers with the inner channel 30 of the spout in the open position of FIG. 2.

Figure 6:
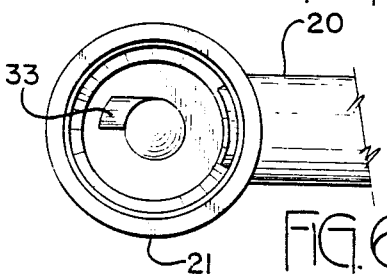
FIG. 6 is a bottom plan view of the underside of the spout member when removed from its swivel mounting base.
Figure 3:
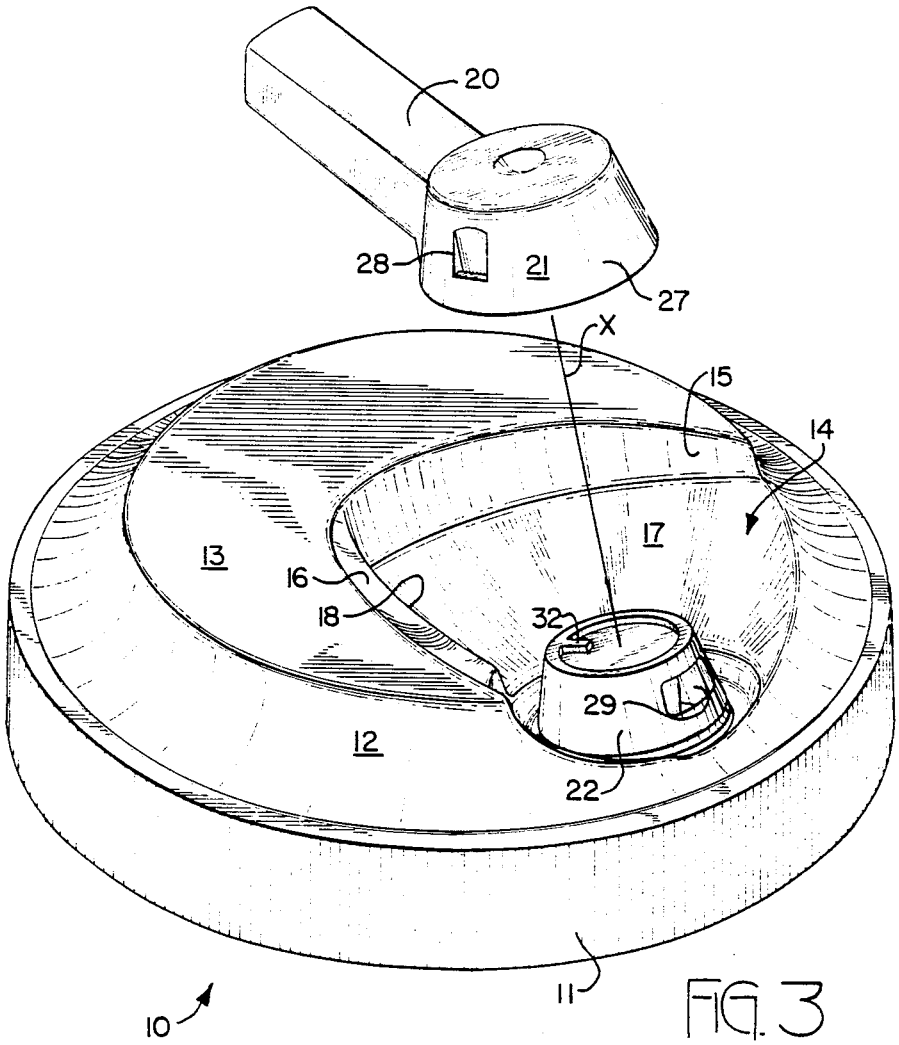
FIG. 3 is an exploded perspective view of the improved dispensing closure of the present invention showing the spout member removed from its swivel mounting in the recessed top of the closure.

As shown in FIGS. 3 and 6, a radial projection 32 extends inwardly from the top periphery of the base 22 and an inner projection 33 in the top of mounting portion 21 is adapted to abut projection 32 and stop the spout when swinging to its fully open position.

Figure 1:
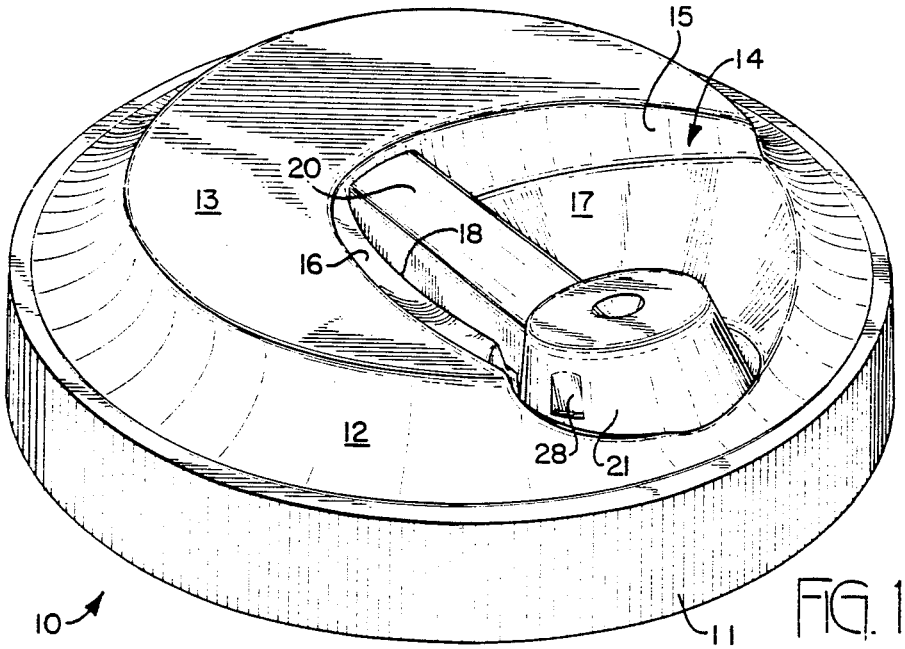
FIG. 1 is a perspective view of the improved dispensing closure of the present invention wherein the spout member is in the closed position.

In the closed position of FIG. 1, the spout 20 and its frusto-conical mounting portion 21 are contained in the recess 14 completely below the phase of the top wall 13 of accidental opening of the spout. In the closed position the vent is closed so that the contents of the container are not exposed to the atmosphere. In the open position the vent is automatically opened to the atmosphere to facilitate immediate flow of liquid when the container and closure are tilted for pouring, and when returned to upright position the upward tilt of the spout prevents dripping.

The improved closure construction consists of only two parts, and is simple and inexpensive to manufacture and assemble. It is adapted to be used with a variety of containers and with a variety of liquids of different viscosities. As such, the objects of the present invention are achieved by the improved closure disclosed herein.

I claim:

1. In a dispenser closure for a container, said closure comprising a normally vertical axis, a downturned peripheral flange, an upper top wall connected to said downturned peripheral flange by an arcuate wall thereby defining an upwardly open off-center recess in the top of the closure, a hollow mounting base within said recess having its axis inclined inwardly toward said closure axis, a pouring spout member adapted to be mounted in said recess on said mounting base for lateral rotation from a closed position wholly within said recess to an upwardly inclined open position projecting outwardly beyond the closure, an opening in said mounting base, an inner channel within said pouring spout which registers with said opening when said spout member is in said open position, a vent aperture in said spout member, and a vent tube depending from said mounting base which communicates with said vent aperture when said spout member is in said open position, thereby facilitating pouring through said spout member when the closure is tilted from its normally vertical axis and inhibiting drippage when returning the closure to its upright position.

2. In a dispenser closure for a container as in claim 1, said pouring spout member having a hollow mounting portion at one end thereof rotatably mounted on said hollow mounting base.

3. In a dispenser closure for a container as in claim 2, said opening in said mounting base communicating with said spout member in the open position being automatically shut off from said spout when said spout is in its closed position by said hollow mounting portion.

4. In a dispenser closure for a container as in claim 3, said vent tube communicating with the atmosphere through the mounting portion of said spout member in the open position, and automatically closing off the atmosphere in the closed position.

5. In a dispenser closure for a container as in claim 1, wherein said recess has stop means for abutting said spout member in its closed position.

6. In a dispenser closure for a container as in claim 1, wherein said mounting base and the mounting portion of said spout member have interengaging means for stopping rotation of said spout member in its open position.

* * * * *

UNITED STATES PATENT AND TRADEMARK OFFICE

CERTIFICATE OF CORRECTION

PATENT NO. : 4,892,234

DATED : January 9, 1990

INVENTOR(S) : Mark H. Bennett

It is certified that error appears in the above-identified patent and that said Letters Patent is hereby corrected as shown below:

Cover page, [73], "Tex." should read --Kans.--.

Column 3, line 11, "frustoconical" should read --frusto-conical--.

Column 3, line 48, "phase" should read --plane--.

Column 3, line 49, after "of" (first occurrence) insert --the closure 10, and are therefore protected from damage or--.

Signed and Sealed this

Twenty-sixth Day of February, 1991

*Attest:*

*Attesting Officer*

HARRY F. MANBECK, JR.

*Commissioner of Patents and Trademarks*